US005894643A

United States Patent [19]

Fehrer

[11] Patent Number: 5,894,643

[45] Date of Patent: Apr. 20, 1999

[54] DEVICE FOR NEEDLING A WEB

[76] Inventor: Ernst Fehrer, Auf der Gugl 28, A-4020 Linz, Austria

[21] Appl. No.: 09/076,749

[22] Filed: May 12, 1998

[30] Foreign Application Priority Data

May 15, 1997 [AT] Austria ..... 832/97
Mar. 12, 1998 [AT] Austria ..... 440/98

[51] Int. Cl.[6] ..... D04H 18/00

[52] U.S. Cl. ..... 28/115; 28/107

[58] Field of Search ..... 28/105, 107, 112, 28/113, 114, 115

[56] References Cited

U.S. PATENT DOCUMENTS 2,896,303 7/1959 Morrill ..... 28/115
3,681,823 8/1972 Dilo ..... 28/115
5,551,134 9/1996 Fehrer ..... 28/115
5,699,596 12/1997 Fehrer ..... 28/115

FOREIGN PATENT DOCUMENTS 265685 10/1968 Austria ..... 28/115

*Primary Examiner*—Michael A. Neas
*Assistant Examiner*—Larry D. Worrell
*Attorney, Agent, or Firm*—Collard & Roe, P.C.

[57] ABSTRACT

A device for needling a web (9), comprising at least one needle board (2) reciprocatingly movable in stitching direction, a stitch base (6) opposite the needle board (2) and a stripper (10) disposed between the stitch base (6) and the needle board (2), which stripper has through holes (11) for the needles (3) of the needle board (2). To create advantageous constructional conditions it is proposed that the stripper (10) should define a compressed-air space (13), which is disposed subsequent to the stripper (10) on the side opposite the stitch base (6) and can be connected with a compressed-air source (16).

4 Claims, 2 Drawing Sheets

DEVICE FOR NEEDLING A WEB

Figure 1:
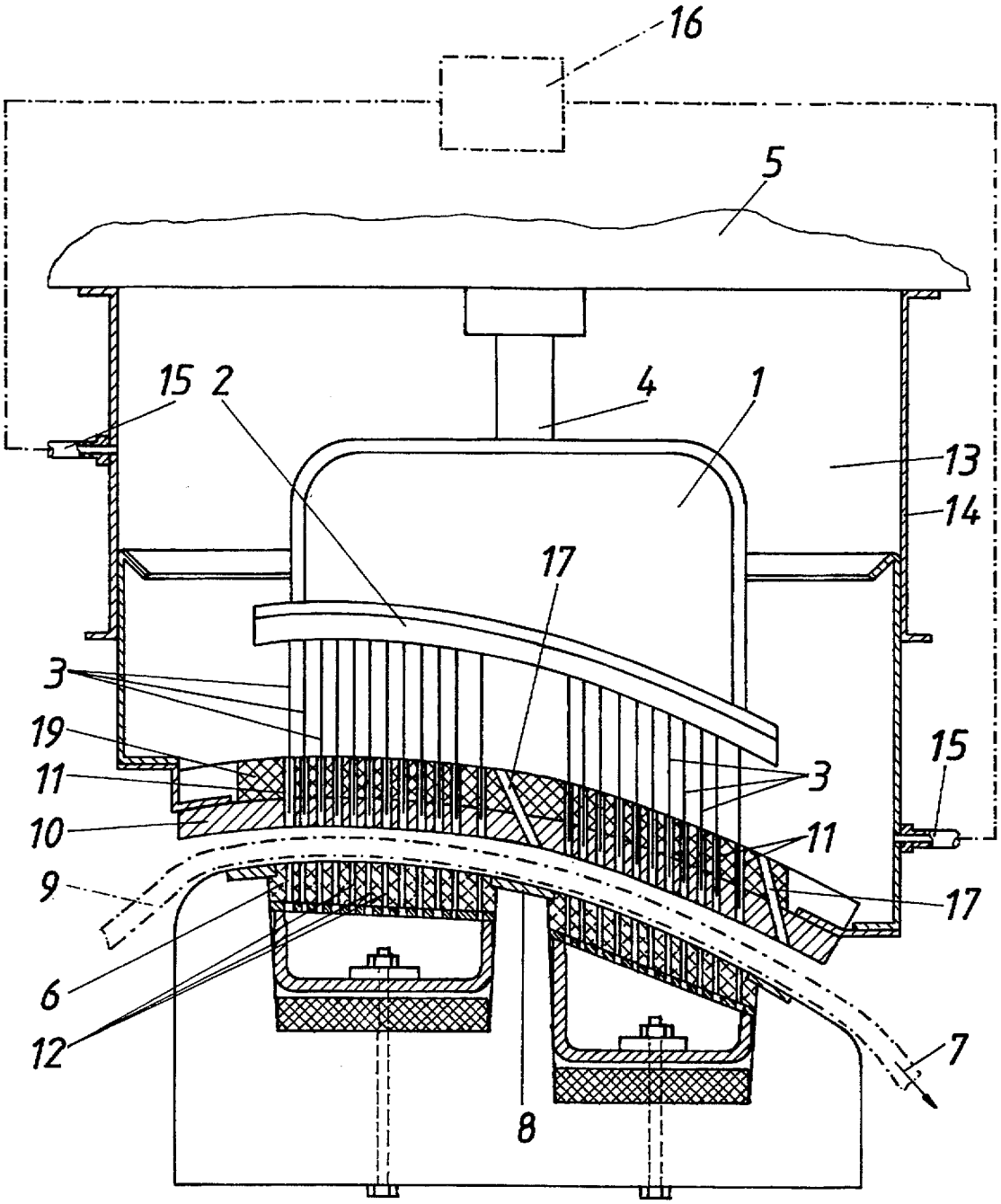

This invention relates to a device for needling a web, comprising at least one needle board reciprocatingly movable in stitching direction, a stitch base opposite the needle board and a stripper disposed between the stitch base and the needle board, which stripper has through holes for the needles of the needle board.

When the needles stitch into the web to be needled, the web is urged against the stitch base, but when the needles are withdrawn from the web, the needles lift the web off the stitch base, because the barbs of the needles necessary for the formation of fibre loops produce a corresponding withdrawal resistance, which is larger than the load acting on the web in opposite direction due to its own weight. To be able to nevertheless ensure a proper withdrawal of the needles from the web, a stripper is used, which retains the web with respect to the needles moving out of the web. But since the web is guided between the stitch base and the stripper with a clearance, the web is reciprocated between the stitch base and the stripper with the lifting frequency of the needle board, which impairs the needling result. With otherwise comparable needling parameters, the needling result is improved with an increasingly smoother web guidance between the stitch base and the stripper.

It is therefore the object underlying the invention to design a device for needling a web as described above with simple constructive measures such that during the needling of the web vibrations of the web transverse to the web surface are largely prevented.

This object is solved by the invention in that the stripper defines a compressed-air space, adjacent to the stripper on the side opposite the stitch base and can be connected with a compressed-air source.

By providing a compressed-air space adjacent to the stripper on the side of the stripper opposite the stitch base it is achieved that compressed air is applied onto the stripper with the effect that through the through holes provided in the stripper for the needles air flows against the web, which due to this blow air is urged against the stitch base, namely also during the movement of withdrawing the needles from the web. The additional pressure load applied onto the web by the blow air acts against the entrainment force of the needles caused by the resistance to a withdrawal of the needles from the web, so that the needles can be withdrawn from the web without lifting the web off the stitch base. This ensures a vibration-reduced web guidance between the stitch base and the stripper, which has a direct advantageous effect on the needling result.

The through holes of the stripper aligned with respect to the web in stitching direction necessarily provide for a correspondingly aligned blow air stream, whose speed depends on the free flow cross-section between the hole walls and the needles penetrating into the through holes, with a given excess pressure in the compressed-air space. By means of this free flow cross-section, the flow conditions can thus be adapted to the respective requirements, where an additional possibility for influencing the flow conditions is obtained by providing nozzle-like tapers in the vicinity of the through holes in the stripper.

A blow air stream directed against the web can support the conveyance of the web during the release of the web by the needles, when this blow air stream has a flow component in direction of web movement. To ensure such conveying effect, the stripper may have, in addition to the through holes for the needles, through holes inclined in direction of web movement, which provide for a blow air stream correspondingly aligned with respect to the direction of web movement.

For needling a web from both sides, without having to provide needle boards on both sides of the web, it is known to use needle boards with needles provided with barbs acting in withdrawal direction of the needles, so that the needles entrain web fibres so as to form loops not in a conventional way when the needles stitch into the web, but only during the withdrawal of the needles from the web. Despite the related higher withdrawal resistance, a vibration-reduced web guidance can be achieved, when blow air is applied onto the web through the through holes of the stripper and the web is thus urged against the stitch base also during the withdrawal movement of the needles.

When needles with barbs acting in stitching direction and needles with barbs acting in withdrawal direction are at least largely uniformly distributed over the needle rows, particularly advantageous conditions are obtained as regards the felting of the web, as both during the impingement of the needles into the web and during the withdrawal of the needles from the web the oppositely directed barbs provide for an entrainment of web fibres, with a web guidance that is smoother due to the application of compressed air.

Figure 2:
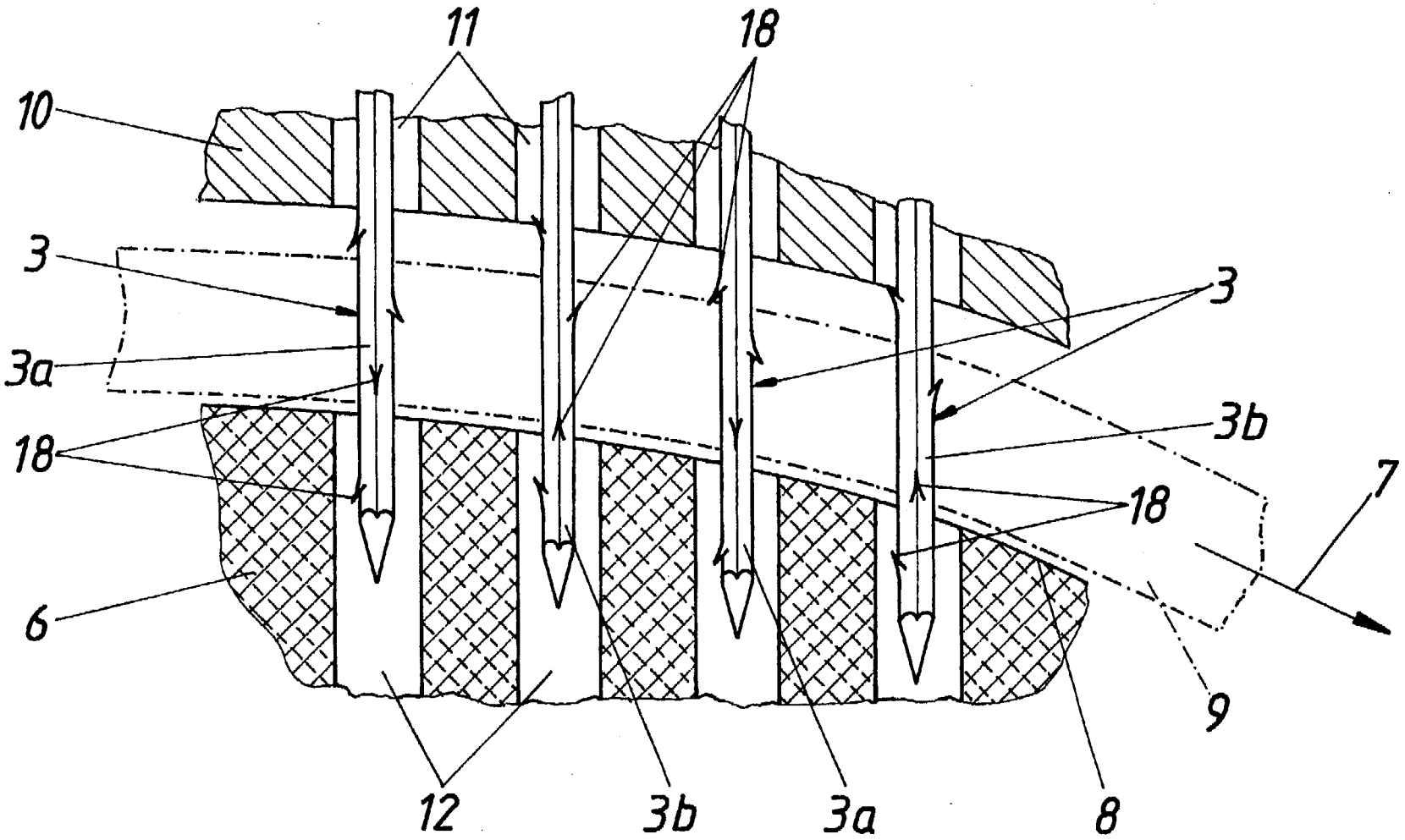

In the drawing the subject-matter of the invention is represented by way of example, wherein:

FIG. 1 represents segments of an inventive device for needling a web in a partly sectional side view, and FIG. 2 represents segments of the needle impingement between the stripper and the stitch base in a longitudinal section on an enlarged scale.

The illustrated device in accordance with the embodiment comprises a needle board 2 mounted on a needle bar 1, where the needles of said needle board are designated with 3. The needle bar 1 is reciprocatingly moved in a conventional way in stitching direction of the needles 3 via a push rod 4 by means of an eccentric drive disposed in a housing 5. Opposite the needle board 2 a stitch base 6 is provided, which consists of two perforated plates disposed one behind the other in direction of web movement 7, which perforated plates are part of a curved guiding surface 8 for the web 9 to be needled. Between the stitch base 6 and the needle board 2 a stripper 10 is disposed, which has a curvature adapted to the guiding surface 8 and is provided with through holes 11 for the needles 3 of the needle board 2. Similarly, the stitch base 6 is provided with through holes 12 for being engaged by the needles 3 when the same penetrate through the web 9. What is novel as compared to conventional devices of this kind is the fact that on the side of the stripper 10 opposite the stitch base 6 a compressed-air space 13 is provided adjacent the stripper 10. This compressed-air space 13 is formed between the stripper 10 and the housing 5 for the drive of the needle board 2 by a shaft 14, which communicates with a compressed-air source 16 via pressure lines 15. In the pressure space 13 an excess pressure can thus build up, which produces blow air streams through the through holes 11 of the stripper 10 for the needles 3. These blow air streams produce an application of compressed air onto the web 9, which due to this application of compressed air is urged against the guiding surface 8 of the stitch base 6, namely also during the withdrawal of the needles 3 from the web 9, which therefore rests against the guiding surface 8. This provides for a largely smooth guidance of the web between the stripper 10 and the stitch base 6, which has an advantageous effect on the needling result.

In addition to the through holes 11 for the needles 3 the stripper 10 may also have through holes 17 inclined in direction of web movement 7, through which likewise flows a stream of blow air. However, the blow air stream through the through holes 17 has a marked flow component in direction of web movement 7, so that by means of this blow air stream a conveying effect can be exerted onto the web 9, when the web 9 is released by the needles 3.

As can be taken from FIG. 2, two different types of needles 3 may be used, namely needles 3 with a working stem 3*a*, whose barbs 18 are aligned in stitching direction, and needles 3, whose working stem 3*b* has barbs 18 in withdrawal direction. Since the needles 3 with the different working stems 3*a* and 3*b* are distributed at least largely uniformly over the needle area, and at least approximately uniform needling in stitching direction is obtained during the impingement of the needles 3, and a likewise at least approximately uniform needling in withdrawal direction during the withdrawal of the needles 3, so that a needling result can be achieved, as it is otherwise only possible by needling a web from both sides in subsequent needling devices. To ensure a sufficient stitch density both for the needles 3 with barbs 18 acting in stitching direction and for the needles 3 with the oppositely directed barbs 18 a fairly high distribution density of the needles 3 should be ensured. This is achieved when the through holes 11 and 12 for the needles 3 in the stripper 10 and in the stitch base 6 can accommodate the needles 3 with comparatively little clearance. Such little clearance in turn requires a corresponding needle guidance, which can be ensured when the needles 3 are guided during the entire needle stroke inside the through holes 11 of the stripper 10, which accordingly should have a sufficient thickness. To ensure that in the case of through holes 11, 12 with comparatively small diameters a risk of damage of the needles 3 can largely be excluded, the stripper 10 and the stitch base 6 may at least partly consist of a material through which the needles 3 can penetrate. In the embodiment in accordance with FIG. 1 the stripper 10 consists of two layers, of which the lower one is made of metal, while the upper layer 19 like the stitch base 6 consists of a rigid foam.

The barbs 18 of the needles 3 with the working stems 3*a* effect an entrainment of fibres in stitching direction, where in particular in the case of higher distribution densities of the needles 3 fibrous material is displaced towards adjacent needles 3 with working stems 3*b*. In the area of engagement of the needles 3 with the working stems 3*b*, whose barbs 18 are aligned against the stitching direction, there is thus sufficient fibrous material for a good entrainment of fibres in withdrawal direction.

What is claimed is:

1. A device for needling a web, comprising at least one needle board reciprocatingly movable in a stitching direction, a stitch base opposite the needle board and a stripper disposed between the stitch base and the needle board, said stripper having through holes for the needles of the needle board and defining a compressed-air space, the compressed-air space being adjacent to the stripper on the side opposite the stitch base and being connected with a compressed-air source.

2. The device as claimed in claim 1, wherein in addition to the through holes for the needles the stripper has additional through holes inclined in direction of web movement.

3. The device as claimed in claim 1, wherein the needles of the needle board comprise barbs acting in a withdrawal direction of the needles.

4. The device as claimed in claim 1, wherein needles with barbs acting in stitching direction and needles with barbs acting in withdrawal direction of the needles are substantially uniformly distributed over the needle rows.

* * * * *